United States Patent [19]

Gross et al.

[11] 4,190,274

[45] Feb. 26, 1980

[54] FRICTION SUPPORT DEVICE

[76] Inventors: David Gross, Laguna Niguel, Calif. 92677; Hugh V. Jorgensen, San Marino, Calif. 91108

[21] Appl. No.: 871,607

[22] Filed: Jan. 23, 1978

[51] Int. Cl.[2] ..... E05C 17/44

[52] U.S. Cl. ..... 292/338; 16/49; 188/67

[58] Field of Search ..... 292/338; 16/49, 82, 16/86 C; 188/67, 129

[56] References Cited

U.S. PATENT DOCUMENTS

| | | | |
|---|---|---|---|
| 1,260,018 | 3/1918 | Oliver | 16/49 UX |
| 2,063,526 | 12/1936 | Snowdon | 16/49 |
| 2,170,718 | 8/1939 | Humphries | 188/67 UX |
| 2,846,211 | 8/1958 | Taylor | 188/67 UX |
| 2,940,552 | 6/1960 | Freyler | 188/67 X |
| 3,086,804 | 4/1963 | Lewin | 188/67 X |
| 3,711,892 | 1/1973 | Tabor | 188/67 X |
| 3,765,053 | 10/1973 | Anweiler | 292/338 X |
| 3,828,893 | 8/1974 | Clark | 188/67 |
| 3,990,542 | 11/1976 | Dent | 188/67 |

*Primary Examiner*—J. Franklin Foss
*Attorney, Agent, or Firm*—Lyon & Lyon

[57] ABSTRACT

A friction support device adapted to support two members in variable positions relative to one another, through the utilization of friction, until an external force is applied to bring the two members together. The friction support device comprises a slide rod inserted into the aperture in a slide holder. As the slide rod is pulled through the slide holder the frictional forces increase, causing the two members connected thereto to remain apart until an external force is applied to bring them together.

12 Claims, 4 Drawing Figures

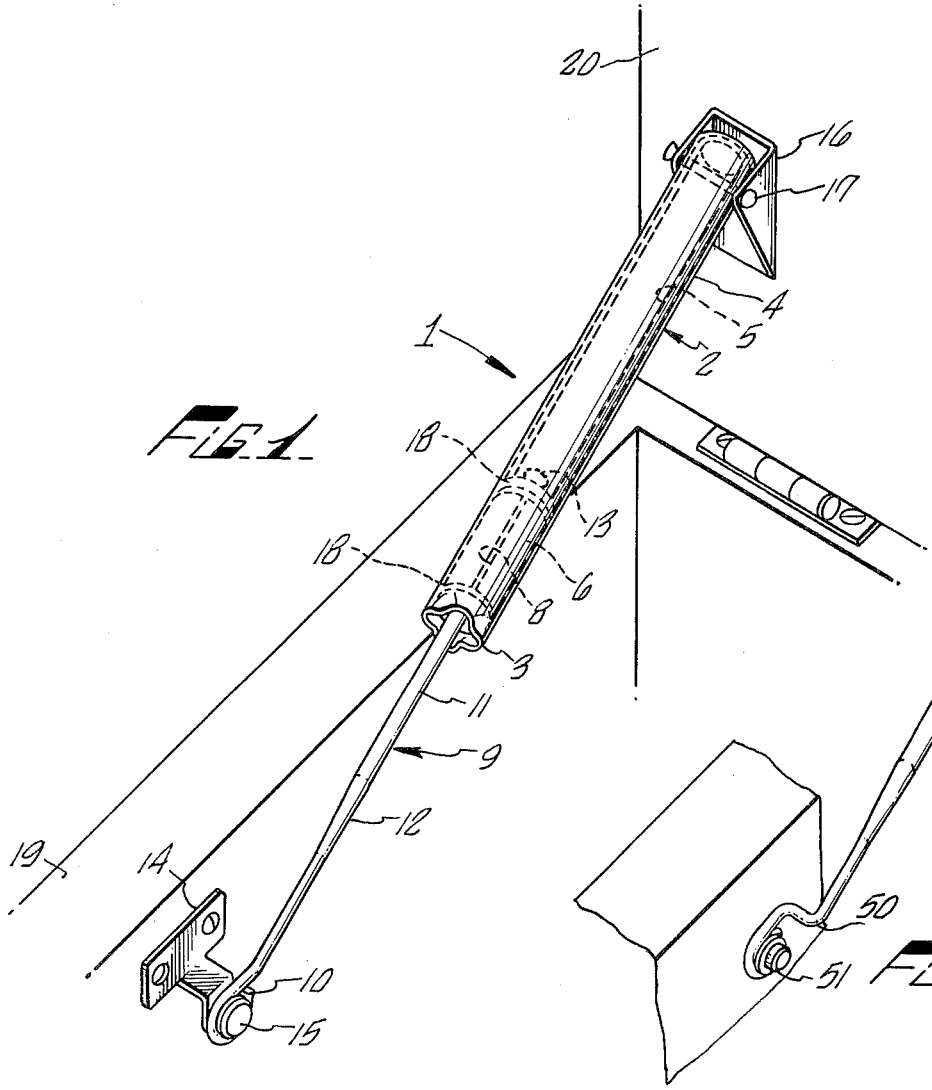
FIG. 1
FIG. 4
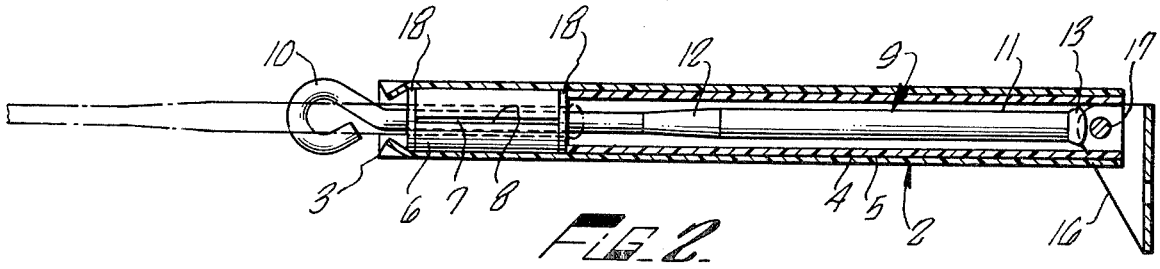
FIG. 2
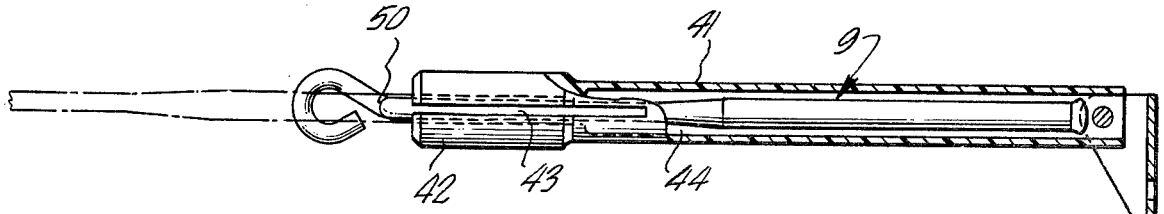
FIG. 3

FRICTION SUPPORT DEVICE

SUMMARY OF THE INVENTION

This invention provides a friction support device adapted to support two members in a position relative to each other apart, through the utilization of friction, until an external force is applied to bring the two members together.

The friction support device comprises a slide rod which engages in a frictional relationship with a slide holder. In one preferred embodiment the slide holder is a cylindrical tube with one or more slits extending its entire length which open into an aperture extending through the central portion of the slide holder, i.e., a split cylinder. The slide holder is inserted into one end of the tube assembly which provides an outer protective covering. In another preferred embodiment the slide holder is an integral part of the tube assembly. The proximal end of the tube assembly in the latter case preferably has a slit which extends lengthwise through the proximal end and which opens into the aperture extending through the central portion of the tube assembly. The proximal end of this tube assembly performs the same function as the slide holder, and the term slide holder as used herein variously refers to the separate member or, in the case of an integrally formed device, to the integral portion of the tube assembly, as the case may be.

The slide rod is inserted through the aperture in the slide holder and extends into the tube assembly. The diameter of the shaft of the slide rod is greater than the diameter of the aperture. In a preferred embodiment the shaft of the slide rod may be tapered in its central portion to gradually increase the diameter of the shaft as it is pulled through the slide holder. The head of the slide rod does not extend into the slide holder, and is fastened to one of the two members whose relative positions, one to the other, are controlled by the device. The distal end of the tube assembly is fastened to the second such member. Accordingly, as the two members are moved apart the slide rod is pulled through the slide holder. The slit in the slide holder gradually expands as the larger diameter of the shaft of the slide rod passes through the slide holder. As a result of the frictional forces involved in pulling the slide rod through the slide holder the two members remain apart when they are released until an external force is applied to bring them together.

The manner in which this and other objects and advantages of the invention are achieved will become more apparent from the detailed description which follows, and from the accompanying drawings of a preferred embodiment, in which like reference numerals indicate like elements and in which:

FIG. 1 is a perspective view of one preferred embodiment of the friction support device attached to a cabinet wall and cabinet door.

FIG. 2 is a partial view of the preferred embodiment of the friction support device shown in FIG. 1.

FIG. 3 is a partial view of another preferred embodiment of the friction support device.

FIG. 4 is a preferred embodiment of the proximal end of the slide rod for fastening the slide rod to a member of the hinged device.

DETAILED DESCRIPTION OF THE INVENTION

The drawings illustrate the preferred embodiments of a friction support device according to the present invention. Referring to FIGS. 1 and 2, there is shown a friction support device 1 comprising generally a tube assembly 2 with a slide holder 6 inserted in its proximal end 3. A slide rod 9 is inserted through the aperture 7 in the slide holder, and extends into the tube assembly.

The tube assembly is preferably manufactured from MH flow grade butyrate which is dark brown in color e.g. Eastman Tenite from Thermoplastic Processes, Inc., of Sterling, N.J. The proximal end of the tube assembly may be crimped or otherwise fashioned in order to secure the slide holder in place. The tube assembly may comprise an outer cylindrical tube 4 and an inner cylindrical sleeve 5 positioned so that its longitudinal axis is generally coincident with the surrounding tube. The inner cylindrical insert abuts a washer 18 adjacent the slide holder 6, or alternately may impinge directly on the end of the slideholder, in either case to prevent the slide holder from moving.

In its preferred embodiment the slide holder 6 is manufactured from a resilient polymeric material e.g., polyoxmethylene. Celcon M90 or M24 made by the Celanese Corporation is such a material. The aperture 7 in the slide holder extends lengthwise through its central portion. The diameter of the aperture 7 may be slightly larger than the diameter of the shaft at the proximal end 10 of the slide rod 9 but it is slightly smaller than the diameter of the shaft at the distal end 11 thereof. The slit 8 in the slide holder extends lengthwise through the slide holder and opens into the aperture. While such a slit is not essential in all embodiments, it allows the best utilization of the spring tension preferably inherent in the resilient material employed.

The slide rod 9 may be made, e.g., of #10 wire. The proximal end 10 of the slide rod is curved to form an aperture through which pin 15 passes to connect the slide rod 9 to a side mount slide bracket 14. The shaft of the slide rod may be tapered in its central portion 12 to gradually increase the diameter of the shaft as it is pulled through the slide holder 6. The diameter of the shaft may vary depending on the amount of friction required. If only a small amount of friction is required due to the light weight of the two members which are to be supported apart from one another, then the diameter of the shaft should approximate the diameter of the aperture in the slide holder. However, if the two members are very heavy and a large amount of friction is required to support them apart, then the diameter of the shaft should be sufficiently larger than the diameter of the aperture in the slide holder so as to engage in an interference relationship. The tail 13 of the slide rod may be smooth cut or slightly rounded, and can be flared slightly in order to prevent the slide rod from pulling out of the slide holder.

Two washers 18 adjacent to each end of the slide holder 6 provide strength to the slide holder as the slide rod 9 is pulled through the slide holder.

To utilize the friction support device a tube bracket 16 is attached to the tube assembly by pin 17, and fastened to a cabinet door 20. The side mount slide bracket 14 is attached to the slide rod 9 by pin 15 and connected to an interior wall 19 of a cabinet. As the cabinet door is raised, the slide rod is pulled through the slide holder 6. As the tapered portion 12 of the shaft passes through the slide holder the increasing diameter of the shaft forces the slit 8 in the slide holder to slowly expand as the frictional forces increase. The door can stop at any position, or the slide rod can be pulled through the slide holder until the tail 13 of the slide holder contacts the washer 18. When the door is released the frictional forces between the slide rod and the slide holder caused by the spring tension in the slide holder keep the cabinet door open until an external force is applied to close the door. The friction support device can also be employed in other objects, e.g. briefcases, or hatchback windows in motor vehicles.

The embodiment shown in FIGS. 1 and 2 can be sealed at each end to form an environmentally protected device. This assists in preventing moisture from reaching the enclosed slide holder which would interfere with the gripping frictional forces. This embodiment is best utilized when the friction support device would be exposed to the elements, as in marine uses.

FIG. 3 illustrates another preferred embodiment of the invention herein. The tube assembly 41 comprises a one piece molded unit, the slide holder being an integral part 42 thereof. This greatly simplifies the friction support device, as it eliminates the requirement for the washers and the inner cylindrical insert used to provide strength and to keep the slide holder in place as shown in FIGS. 1 and 2. The entire tube assembly is preferably manufactured from the resilient polymer material used to manufacture the slide holder embodiment shown in FIGS. 1 and 2 e.g., Celecon M90 or M24. The proximal end 42 of the tube assembly has a slit 43 which extends lengthwise through the proximal end, and which opens into the aperture 44 extending through the central portion of the tube assembly. The proximal end may also be enlarged so that the walls are thicker to provide additional strength and spring tension. The slide rod 9 is identical to the slide rod described above, and the friction support device operates in the same manner.

FIG. 4 illustrates another means for fastening the slide rod 9 to a member of the hinged apparatus. The proximal end 50 of the slide rod is fashioned in a z-shaped manner, and is connected directly to one of the supported members by screw 51. This eliminates the need for the side mount slide bracket shown in FIG. 1.

While the above description of the preferred embodiment and the drawings show a cylindrical shape, it is to be understood that the present invention is capable of a variety of elongate or other shapes. The term "cylindrical" as used herein therefore connotes rectangular, cube, prism, pyramidical, and irregularly shaped as well as cylindrical in its classic sense. The particular shape chosen for the tube assembly may depend on cosmetic as well as functional motives, depending on the specific application.

While the preferred embodiment and application of this invention has been shown and described, it would be apparent to those skilled in the art that many more modifications are possible without departing from the inventive concept herein described. The invention, therefore is to be limited only by the lawful scope of the claims which follow.

We claim:

1. A friction support device for supporting two members in variable positions relative to one another comprising:

a tube assembly to provide an outer protective covering having an aperture extending lengthwise through its central portion;

a slide holder of a resilient polymeric material having an aperture extending lengthwise through its central portion, the slide holder being inserted into one end of the tube assembly;

a slide rod having a tapered shaft which is inserted through the aperture in the slide holder and extends into the tube assembly, and which frictionally engages the slide holder;

means for fastening the tube assembly to the first member;

means for fastening the proximal end of the slide rod to the second member.

2. A friction support device as in claim 1, wherein said slide holder comprises a cylindrical tube with a slit which extends the entire length of the slide holder and which opens into the aperture extending through the central portion of the slide holder.

3. A friction support device as in claim 1 wherein the tube assembly comprises an outer cylindrical tube with a cylindrical insert abutting the slide holder.

4. A friction support device as in claim 1 wherein the proximal end of the slide rod has a generally z-shaped configuration.

5. A friction support device for supporting two members in variable positions relative to one another comprising:

a tube assembly of a resilient polymeric material having an aperture which extends lengthwise through the central portion of the tube assembly;

a slide rod having a tapered shaft which is inserted through the aperture in the tube assembly at the proximal end, and which frictionally engages the proximal end of the tube assembly;

means for fastening the tube assembly to the first member;

means for fastening the proximal end of the slide rod to the second member.

6. A friction support device as in claim 5 wherein the proximal end of the tube assembly has a slit which extends lengthwise and which opens into the aperture extending through the central portion of the tube assembly.

7. A friction support device as in claim 5 wherein the proximal end of the slide rod has a generally z-shaped configuration.

8. An assembly comprising first and second members respectively affixed to the opposite ends of a friction support device according to claim 1 such that the position of the members relative to one another may be variable and manually adjusted.

9. An assembly according to claim 8 wherein said members are pivotally hinged, one to another.

10. An assembly comprising first and second members respectively affixed to the opposite ends of a friction support device according to claim 6 such that the position of the members relative to one another may be variable and manually adjusted.

11. An assembly according to claim 10 wherein said members are pivotally hinged, one to another.

12. An assembly comprising first and second members respectively affixed to the opposite ends of a friction support device such that the position of the members relative to one another may be variable and manually adjusted, said friction support device comprising:

a tube assembly of a resilient polymeric material having an aperture which extends lengthwise through the central portion of the tube assembly, the proximal end of the tube assembly having a slit which extends lengthwise and which opens into the aperture extending through the central portion of the tube assembly;

a slide rod having a tapered shaft which is inserted through the aperture in the tube assembly at the proximal end thereof such that the slide rod frictionally engages the proximal end of the tube assembly, the proximal end of the slide rod having a generally z-shaped configuration;

means for fastening the tube assembly to the first member;

means for fastening the proximal end of the slide rod to the second member.

* * * * *